US011118320B2

(12) United States Patent
Patterson

(10) Patent No.: US 11,118,320 B2
(45) Date of Patent: Sep. 14, 2021

(54) ANIMAL WASTE EXTRACTION DEVICE

(71) Applicant: Helen Delsea Patterson, Chester, PA (US)

(72) Inventor: Helen Delsea Patterson, Chester, PA (US)

( * ) Notice: Subject to any disclaimer, the term of this patent is extended or adjusted under 35 U.S.C. 154(b) by 141 days.

(21) Appl. No.: 16/681,009

(22) Filed: Nov. 12, 2019

(65) Prior Publication Data

US 2020/0157753 A1 May 21, 2020

Related U.S. Application Data

(60) Provisional application No. 62/917,107, filed on Nov. 16, 2018.

(51) Int. Cl.
*E01H 1/12* (2006.01)
*H05B 3/00* (2006.01)

(52) U.S. Cl.
CPC ..... *E01H 1/1206* (2013.01); *H05B 3/0014* (2013.01)

(58) Field of Classification Search
CPC ..... E01H 1/1206; E01H 2001/1293; H05B 3/0014
See application file for complete search history.

(56) References Cited

U.S. PATENT DOCUMENTS 3,786,780 A 1/1974 Pezzino
4,225,174 A 9/1980 Hennessy et al.
4,335,678 A 6/1982 Garza et al.
5,290,080 A 3/1994 Yoshioka
5,868,447 A 2/1999 Clark et al.
6,196,601 B1 * 3/2001 Juntunen, Jr. ..... E01H 1/1206 294/1.4
8,196,980 B1 * 6/2012 Banks ..... E01H 1/1206 294/1.3
9,974,282 B2 * 5/2018 Castano ..... A01K 23/005
2004/0004361 A1 * 1/2004 Foster ..... E01H 1/1206 294/1.4
2004/0135386 A1 * 7/2004 Pineda ..... E01H 1/1206 294/1.4
2010/0176611 A1 * 7/2010 Merino-Garcia ..... E01H 1/1206 294/1.3
2010/0259055 A1 10/2010 Shoseyov et al.
2014/0152031 A1 * 6/2014 Ballacchino ..... E01H 1/1206 294/1.3
2014/0152033 A1 * 6/2014 Wilson ..... E01H 1/1206 294/1.4
2015/0115634 A1 4/2015 Young
2015/0282456 A1 * 10/2015 Harley ..... A01K 27/006 119/796

* cited by examiner

*Primary Examiner* — Stephen A Vu
(74) *Attorney, Agent, or Firm* — McNees Wallace & Nurick LLC

(57) ABSTRACT

An animal waste extraction device including a gripper having a plurality of fingers movable between an open position and a closed position, each finger having a retainer proximate an end of the finger adapted to be selectively heatable to a first temperature. In response to the plurality of fingers being in the closed position and surrounding an animal waste, a layer surrounding the animal waste and separating the animal waste and the plurality of fingers, the finger retainers being heatable to the first temperature sufficient to at least partially melt the layer proximate the finger retainers, the layer forming an enclosure surrounding the animal waste.

11 Claims, 3 Drawing Sheets

ANIMAL WASTE EXTRACTION DEVICE

BACKGROUND OF THE INVENTION

The invention relates generally to pet care accessories and in particular to an animal waste extraction device. For a pet owner walking an animal such as a dog, the pet owner is usually required by local ordinances to collect the dog waste, day or night. Removing the dog waste can be an uncomfortable and messy task for those unwilling or unable to use a bag and make indirect manual contact with the dog waste, as conventional devices coming into direct physical contact with the dog waste present cleanliness and lingering undesirable odors. In addition, such conventional devices require the pet owner to deeply bend at the waste or otherwise lower herself/himself to access and remove the animal waste, which can be difficult. Furthermore, such walks may occur at night, presenting further difficulties or even dangers to the pet owner.

There is a need in the art for a device and method that permits animal waste removal that addresses these disadvantages.

SUMMARY OF THE INVENTION

In one embodiment, an animal waste extraction device includes a gripper having a plurality of fingers movable between an open position and a closed position, each finger having a retainer proximate an end of the finger adapted to be selectively heatable to a first temperature. The device further provides in response to the plurality of fingers being in the closed position and surrounding an animal waste, a layer surrounding the animal waste and separating the animal waste and the plurality of fingers, the finger retainers being heatable to the first temperature sufficient to at least partially melt the layer proximate the finger retainers, the layer forming an enclosure surrounding the animal waste.

In another embodiment, an animal waste extraction device includes a hollow elongated member having a first end and a second end, and a gripper having a plurality of fingers, each finger having a retainer adapted to be selectively heated to a first temperature. The device further includes an actuator connected to the hollow elongated member and to the gripper, the actuator movable between a first position and a second position. The device further includes in response to the actuator being in the first position, the plurality of fingers is in a closed retracted and located entirely inside the elongated member. The device further includes in response to the actuator being in the second position, the plurality of fingers is in an open position and located entirely outside of the second end of the elongated member, the finger retainers insertable inside of a cover having an open end and a closed end, the finger retainers engaging the open end. The device further includes in response to the actuator being in a third position between the first position and the second position, the plurality of fingers is in the closed position and extending at least partially outside the second end and surrounding the animal waste, the cover separating the animal waste and the plurality of fingers, the retainers being heatable to the first temperature sufficient to at least partially close the open end of the cover.

In a further embodiment, a method of extracting animal waste includes providing a gripper having a plurality of fingers movable between an open position and a closed position, each finger having a retainer proximate an end of the finger adapted to be selectively heatable to a first temperature. The method further includes engaging a layer with the plurality of fingers, and surrounding an animal waste with the plurality of fingers in the closed position, the layer separating the plurality of fingers from the animal waste. The method further includes heating the finger retainers sufficient to at least partially melt the layer proximate the finger retainers, the layer forming an enclosure surrounding the animal waste.

Other features and advantages of the present invention will be apparent from the following more detailed description, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

The present disclosure is directed to an animal waste extractor that includes a sound-emanating device capable of sounding an alarm either by itself or in combination with illumination devices to illuminate a surrounding area at night. The extractor is sized to permit animal waste access/removal without the pet owner needing to bend at the waist. Furthermore, the animal waste extractor does not make direct contact with the animal waste, utilizing a material layer that is formed into an enclosure for conveniently depositing the animal waste therein.

Figure 1:
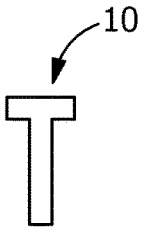
FIG. 1 is a side view of an exemplary animal waste extractor.
Figure 2:
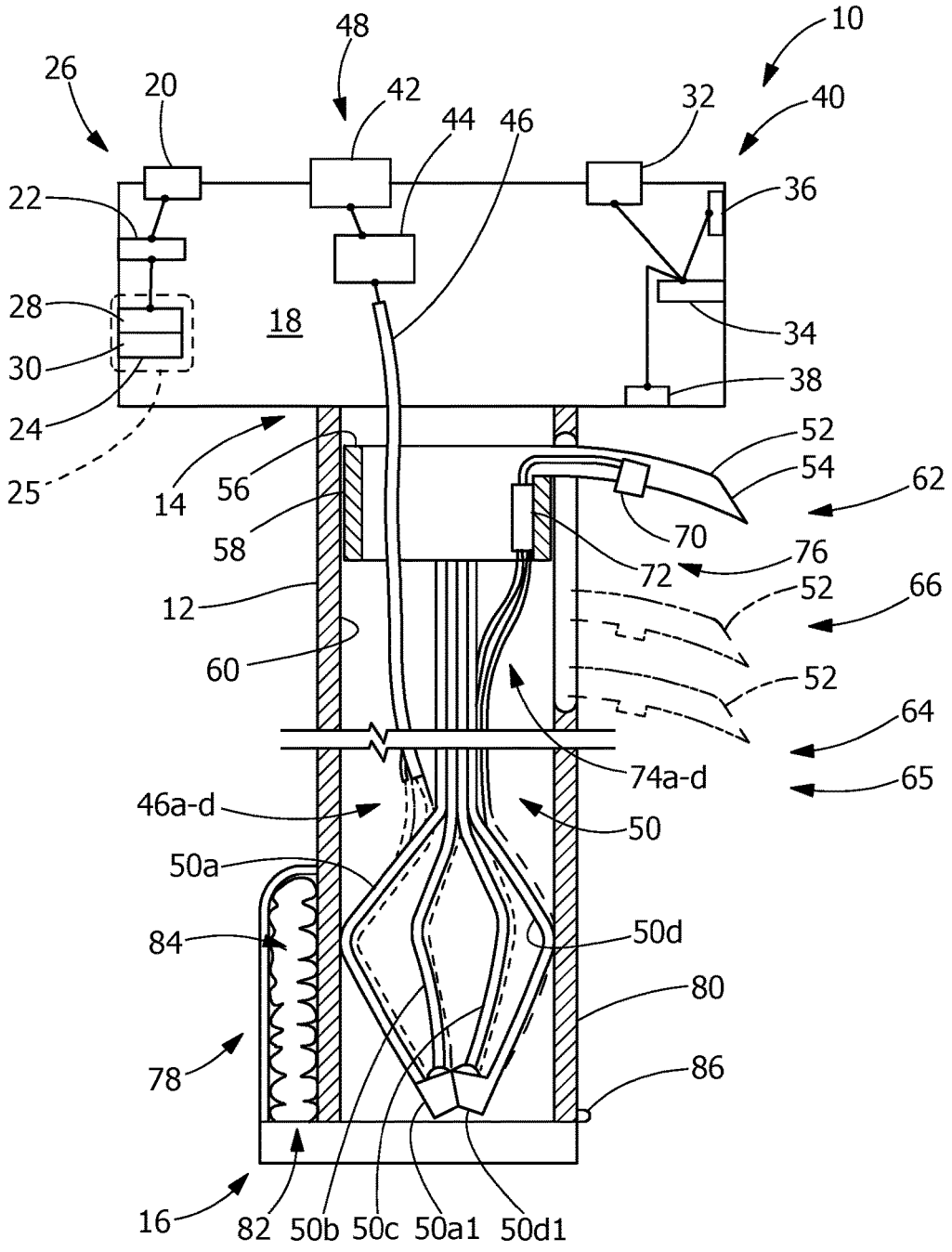
FIG. 2 is an enlarged combined schematic and cross section of the animal waste extractor of FIG. 1.

FIGS. 1-2 show an exemplary animal waste extractor 10. As further shown in FIG. 2, animal waste extractor 10 includes a hollow elongated member 12 having opposed ends 14, 16. Positioned proximate to end 14 is a handle 18 that includes several features usable for nighttime walking. For example, handle 18 includes a switch 20 connected to a battery 22 and a combination device 24, collectively forming an electrical circuit 26 in a known manner. Switch 20 is conveniently manually accessible by a pet owner (not shown) while walking. Combination device 24 is a combination of a sound-emanating device 28, such as an audio speaker for sounding an alarm in case of an unwanted encounter or other emergency situation, as well as an illumination device 30 such as a light emitting diode (LED) in response to actuating switch 20 which results in closing electrical circuit 26. Optionally, a protective screen 25 surrounding combination device 24 such as constructed of plastic or other weather impervious material may be utilized. Handle 18 further includes a switch 32 connected to a battery 34 and illumination devices 36, 38, collectively forming an electrical circuit 40 in a known manner. When the waste extractor is carried in one hand by handle 18 with elongated member 12 in a generally vertical orientation and switch 32 is actuated to close electrical circuit 40, illumination devices 36, 38 are positioned to provide both forward-directed illumination (by illumination device 36) as well as downwardly-directed illumination (by illumination device 38) to illuminate the path of the pet owner.

As shown in FIG. 2, handle 18 further includes a switch 42 connected to a battery 44 that is connected to a conductor 46, collectively forming an electrical circuit 48 in a known manner. As will be further discussed below, conductor 46 bifurcates into a plurality of conductor strands 46*a*, 46*b*, 46*c*, 46*d* (FIG. 4) that are each connected to a corresponding gripper finger 50*a*, 50*b*, 50*c*, 50*d* (FIG. 4) of gripper 50. Conductor 46 incorporates a predetermined excess length or slack, thereby permitting relative movement of gripper 50 relative to the end of conductor 46 affixed to battery 44.

As shown in FIG. 2, an actuator 52 includes a handle 54 that is secured to a body 56. Body 56 includes an outer surface 58 that corresponds to and is slidably movable relative to an inner surface 60 of elongated member 12. Gripper 50 is secured to body 56 so that gripper 50 and body 56 move in unison. Handle 54 of actuator 52 extends through and is slidably movable within a slot 68 formed in elongated member 12 between a retracted, closed gripper position 62, in which gripper fingers 50*a*, 50*b*, 50*c*, 50*d* of gripper 50 are in a closed position and are located entirely inside of elongated member 12, and an extended, open gripper position 64, in which gripper fingers 50*a*, 50*b*, 50*c*, 50*d* of gripper 50 are in an open position and are located entirely outside of elongated member 12. Intermediate retracted, closed gripper position 62 and extended, open gripper position 64 is an intermediate gripper position 66 in which gripper fingers 50*a*, 50*b*, 50*c*, 50*d* of gripper 50 are in a closed position and are located partially inside of elongated member 12. In one embodiment, gripper fingers 50*a*, 50*b*, 50*c*, 50*d* of gripper 50 are in a closed, extended position 65 and are located entirely outside of elongated member 12, with handle 54 being in the same location as with extended, open position 64.

As further shown in FIG. 2, and as will be discussed in further detail below, actuator 52 includes a switch 70 connected to a battery 72, conductive strands 74*a*, 74*b*, 74*c*, 74*d*, and corresponding gripper fingers 50*a*, 50*b*, 50*c*, 50*d*, collectively forming an electrical circuit 76 in a known manner.

Figure 3:
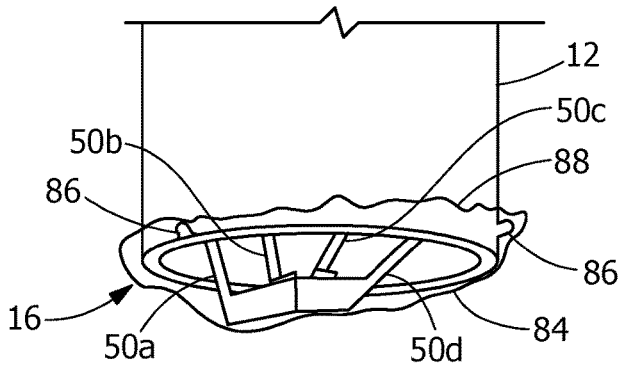
FIG. 3 is a partial upper perspective view of an exemplary gripper partially extending from the animal waste extractor of FIG. 2 in contact with a layer secured to an end of the animal waste extractor.

As further shown in FIG. 2, a protruding region 78 proximate to end 16 of elongated member 12 extending along outer surface 80 of elongated member 12 defines a compartment 82 securing a plurality of covers 84, each cover 84 adapted to be temporarily secured over end 16 by retainers 86 of elongated member 12 for engaging gripper fingers 50*a*, 50*b*, 50*c*, 50*d* as the gripper fingers are moved from position 62 toward position 66, i.e., the gripper fingers are moved from a position entirely inside of elongated member 12 toward a position entirely outside of elongated member 12. For example, FIG. 3 shows gripper fingers 50*a*, 50*b*, 50*c*, 50*d* engaging cover 84 that is outstretched over end 16 of elongated member 12, and open end 88 of cover being temporarily secured to elongated member 12 by plurality of retainers 86. In one embodiment, open end 88 includes an elastic material such that cover 84 resembles a shower cap.

Figure 4:
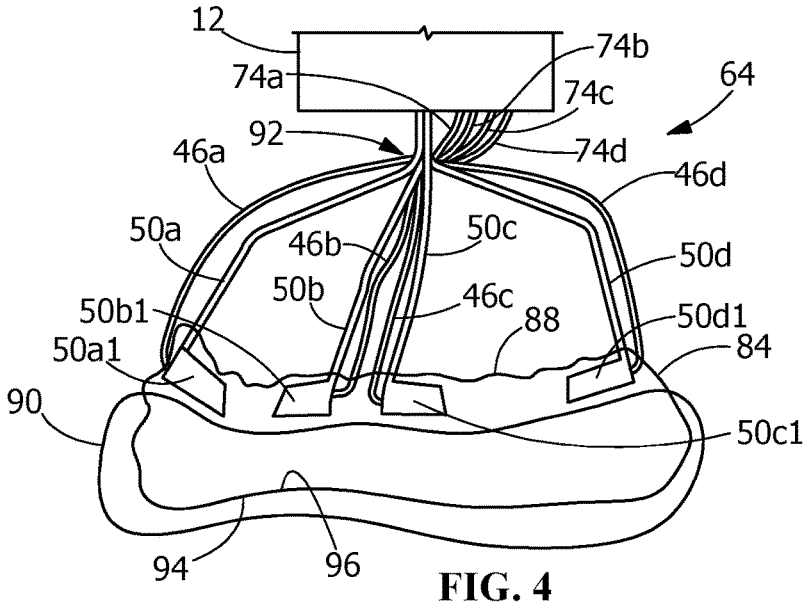
FIG. 4 is a side view of the gripper in an open position engaging the layer of FIG. 3.
Figure 5:
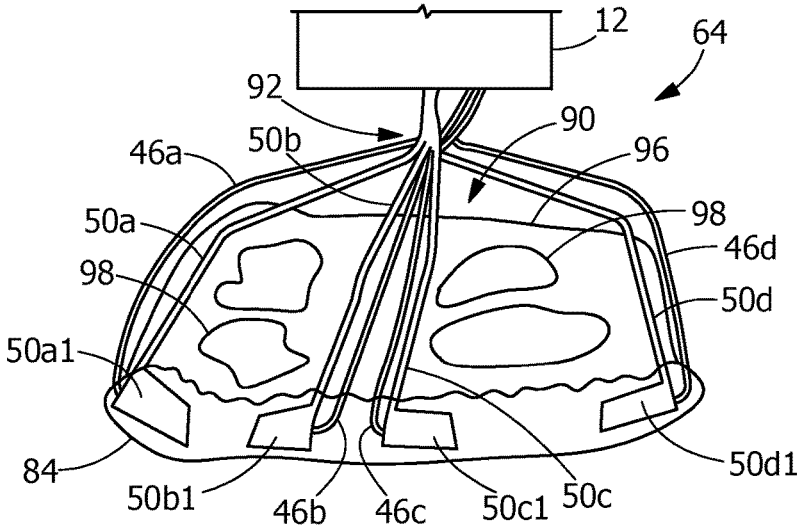
FIG. 5 is a side view of the layer-engaged gripper in an open position being lowered over animal waste, the layer separating the gripper and the animal waste.
Figure 6:
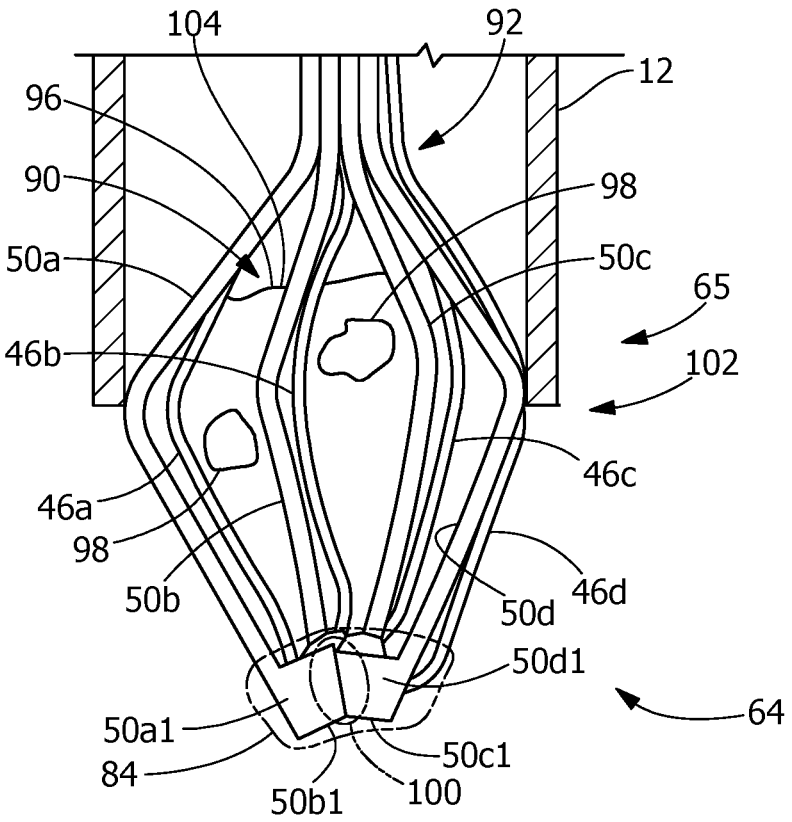
FIG. 6 is a side view of the layer-engaged gripper of FIG. 5 in a closed position surrounding animal waste.

FIG. 4 shows gripper fingers 50*a*, 50*b*, 50*c*, 50*d* in position 64 entirely outside of elongated member 12 and in engagement with cover 84. More specifically, gripper fingers 50*a*, 50*b*, 50*c*, 50*d* each extend to corresponding retainers 50*a*1, 50*b*1, 50*c*1, 50*d*1 that are temporarily engaged and secured proximate open end 88 of cover 84. For purposes of clarity, and as shown in FIG. 4, a predominant portion 90 of cover 84 extends beneath the gripper fingers, opposite a base 92 of the gripper fingers. Predominant portion 90 of cover 84 includes an outer surface 94 and an inner surface 96. It is appreciated by one skilled in the art that in use, as is shown in FIGS. 5-6, as a result of lowering the gripper fingers in position 64 over animal waste 98, animal waste 98 and predominant portion 90 of cover 84 is urged upward and between the gripper fingers until portion 90 is proximate to base 92 of the gripper fingers, with inner surface 96 facing the gripper fingers. That is, in FIGS. 5-6, in addition to open end 88 of cover 84 surrounding and remaining temporarily engaged and secured to an outer side of retainers 50*a*1, 50*b*1, 50*c*1, 50*d*1, a portion of predominant portion 90 wraps around the bottom sides of retainers 50*a*1, 50*b*1, 50*c*1, 50*d*1 as the predominant portion 90 is urged upward and between the gripper fingers, and moreover, an opposed inner side of the retainers, as well as the inner sides of gripper fingers 50*a*, 50*b*, 50*c*, 50*d* are brought into contact with or face inner surface of predominant portion 90. Stated another way, as shown in FIG. 5, when gripper fingers 50*a*, 50*b*, 50*c*, 50*d* are lowered over animal waste 98, cover 84 separates each of gripper fingers 50*a*, 50*b*, 50*c*, 50*d* and retainers 50*a*1, 50*b*1, 50*c*1, 50*d*1 from animal waste 98.

After gripper fingers 50*a*, 50*b*, 50*c*, 50*d* and cover 84 in position 64 are lowered over and surround animal waste 98 as shown in FIG. 5, then as shown in FIG. 6, gripper fingers 50*a*, 50*b*, 50*c*, 50*d* and cover 84 are urged into a closed position surrounding animal waste 98, forming a neck 100 in cover 84. That is, retainers 50*a*1, 50*b*1, 50*c*1, 50*d*1 are brought into proximity with one another separated by corresponding portions of cover 84 (it is understood that animal waste 98 may also be on cover 84) and forming neck 100 in cover 84.

In one embodiment, as shown collectively in FIGS. 2 and 6, bringing retainers 50*a*1, 50*b*1, 50*c*1, 50*d*1 into proximity with one another may be achieved by activating electrical circuit 76, in which as a result of actuating switch 70, electrical current is provided through conductor strands 74*a*, 74*b*, 74*c*, 74*d* that are secured to or are in electrical communication with corresponding gripper fingers 46*a*, 46*b*, 46*c*, 46*d*. That is, one or both of conductor strands 74*a*, 74*b*, 74*c*, 74*d* and corresponding gripper fingers 46*a*, 46*b*, 46*c*, 46*d* are at least partially composed of a material having shape memory, such as nitinol wire, in which in response to the shape-memory wire being sufficiently heated, such as by electrical current, the shape-memory wire returns to a predetermined shape, which in this instance, would urge gripper fingers 46*a*, 46*b*, 46*c*, 46*d* toward position 65 (FIG. 6). In one embodiment, as shown in FIG. 6, partially retracting gripper fingers 46*a*, 46*b*, 46*c*, 46*d* toward position 66 (moving handle 54 (FIG. 2) from extending position 64 to intermediate position 66 (FIG. 2) resulting in inner surface 60 (FIG. 2) of elongated member 12 (FIG. 2) contacting and urging the gripper fingers toward a closed position.

Once the gripper fingers are closed surrounding cover 84 and animal waste 98 as shown in FIG. 6, the pet owner (not shown) activates electrical circuit 48 shown in FIG. 2, by pressing switch 42, providing electrical current through conductor 46 and then through conductor strands 46*a*, 46*b*, 46*c*, 46*d* that are connected to corresponding gripper fingers 46*a*, 46*b*, 46*c*, 46*d* or directly connected to gripper retainers 50*a*1, 50*b*1, 50*c*1, 50*d*1. Battery 44 acts as a heat source as is further discussed below. In one embodiment, one or more of conductor 46, conductor strands 46*a*, 46*b*, 46*c*, 46*d*, gripper fingers 46*a*, 46*b*, 46*c*, 46*d* or gripper retainers 50*a*1, 50*b*1, 50*c*1, 50*d*1 (or any combination thereof) are at least partially composed of an air-stable resistive-heating material such as nichrome or other suitable material, such as conventionally used as heating elements. As a result of activating electrical circuit 48, gripper retainers 50*a*1, 50*b*1, 50*c*1, 50*d*1 are heated to a sufficient temperature to at least partially melt neck 100. As a result of neck 100 being at least partially melted, cover 84 is transformed into an enclosure 102 surrounding animal waste 98, with inner surface 96 of cover 84 becoming outer surface of enclosure 102, which enclosure 102 is more clearly shown by itself in FIG. 7. In one embodiment, the pet owner actuates switch 42 until neck 100 is at least partially melted. In one embodiment, actuating switch 42 automatically activates electrical circuit 48 for a predetermined period of time sufficient to at least partially melt neck 100.

Figure 7:
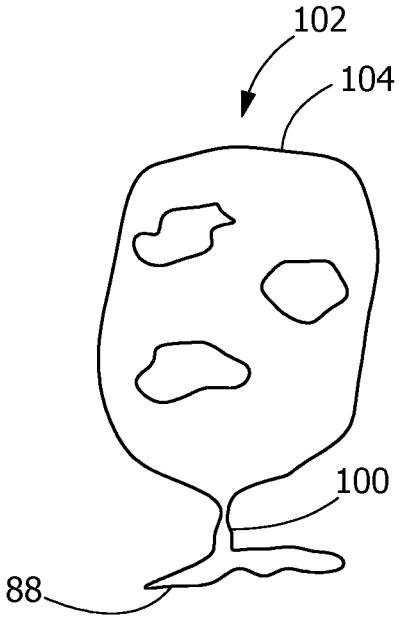
FIG. 7 is a side view of an enclosed formed from the layer of FIG. 6 filled with animal waste in preparation for disposal.
Figure 8:
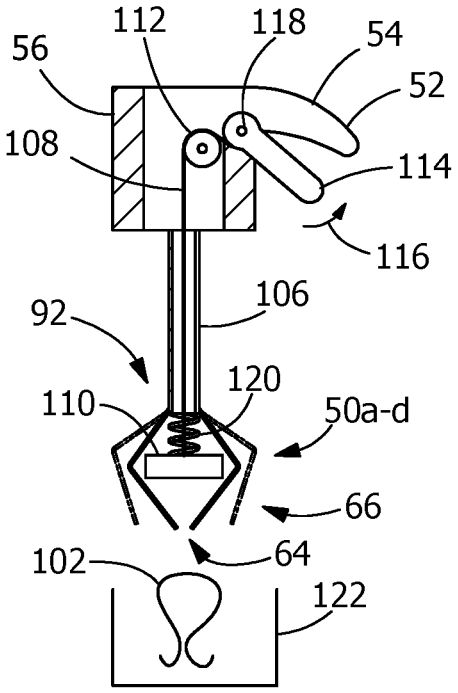
FIG. 8 is a cutaway side view of the animal waste extractor of FIG. 1.

Once neck 100 has been at least partially melted as shown in FIGS. 6-7, then in one embodiment, as shown in FIG. 8, actuator 52 further includes a hollow member 106 secured at one end to body 56, the opposite end of member 106 extending between gripper fingers 50*a*-*d* proximate base 92. A cable 108 is connected to a disk 110 at one end of cable 108 that is positioned between gripper fingers 50*a*-*d* proximate base 92, which cable extending through hollow member 106, engaging a pulley 112 and connecting to an end of a lever pivotably connected to handle 54. In response to rotational movement 116 of lever 114 about pivot 118, cable 108 urges disk 110 to engage gripper fingers 50*a*-*d*, which gripper fingers 50*a*-*d* similarly being urged from closed position 64 toward open position 66, releasing enclosure 102 (FIG. 6) filled with animal waste 98, such as directly releasing the animal waste by force of gravity into a an animal waste disposal region 122. Once lever 114 is released, a spring 120 positioned between gripper fingers 50*a*-*d* and disk 110 that had been compressed in response to the disk being urged to engage gripper fingers 50*a*-*d* applies a retention force to urge disk 110 out of engagement with fingers 50*a*-*d*, thereby urging gripper fingers 50*a*-*d* similarly being urged from open position 66 toward closed position 64.

In one embodiment, gripper fingers 50*a*-*d* are flexible, and do not need to be at least partially composed of a material having shape memory, the gripper fingers being biased between open and closed positions as a result of being entirely contained inside of the elongated member, being entirely outside of the elongated member, or being in a partially open position and partially contained inside of the elongated member.

In one embodiment, an arrangement to change the gripper fingers 50*a*-*d* from a closed position to an open position may utilize cables directly connected to each of the gripper fingers 50*a*-*d*, in a manner similar to that depicted in FIG. 8.

In one embodiment, a different number than four gripper fingers may be used. In one embodiment, not every gripper finger includes a gripper retainer, or stated another way, the number of gripper fingers may be different than the number of gripper retainers.

In one embodiment, a layer of material, instead of a cover with an elastic open end, may be positioned in contact with the gripper fingers and gripper retainers, so long as the layer is sufficiently sized to prevent contact between the gripper fingers, the retainers and the animal waste the layer forming an enclosure filled with animal waste for removal in a manner as previously discussed.

It is to be understood that illumination devices 36, 38 may be used at any time to illuminate a region associated with locating, surrounding and extracting animal waste as disclosed herein.

It is to be understood that conventionally sized batteries, singly or in series, may be used.

The present invention has been described as a device and method for removing animal waste. It will be understood that the above description is merely illustrative of the applications of the principles of the present invention, the scope of which is to be determined by the claims viewed in light of the specification. Other variants and modifications of the invention will be apparent to those of skill in the art.

What is claimed is:

1. An animal waste extraction device comprising:

a gripper having a plurality of fingers movable between an open position and a closed position, each finger having a retainer proximate an end of the finger adapted to be selectively heatable to a first temperature;

a hollow elongated member having a first end and a second end; and an actuator connected to the hollow elongated member and to the gripper, the actuator movable between a first position and a second position;

wherein in response to the actuator being in the first position, the plurality of fingers is in the closed position and located entirely inside the elongated member;

wherein in response to the actuator being in the second position, the plurality of fingers is in the open position and located entirely outside of the second end of the elongated member, the finger retainers engaging the layer;

wherein in response to the actuator being in a third position between the first position and the second position, the plurality of fingers are in the closed position and extending at least partially outside the second end of the hollow elongated member surrounding the animal waste, the layer separating the animal waste and the plurality of fingers;

wherein in response to the plurality of fingers being in the closed position and surrounding an animal waste, a layer surrounding the animal waste and separating the animal waste and the plurality of fingers, the finger retainers being heatable to the first temperature sufficient to at least partially melt the layer proximate the finger retainers, the layer forming an enclosure surrounding the animal waste.

2. The device of claim 1, wherein the finger retainers are at least partially composed of an air-stable resistive-heating material, or the finger retainers are each adapted to receive a corresponding conductor, or a combination thereof.

3. The device of claim 1, wherein the first end of the hollow elongated member includes a sound-emanating device and at least one illumination device.

4. The device of claim 1, wherein the first end of the hollow elongated member includes a heat source for selectively heating the finger retainers.

5. The device of claim 4, wherein the heat source is a battery.

6. An animal waste extraction device comprising:

a gripper having a plurality of fingers movable between an open position and a closed position, each finger having a retainer proximate an end of the finger adapted to be selectively heatable to a first temperature; and a hollow elongated member having a first end and a second end;

wherein the first end of the hollow elongated member includes a combination sound-emanating device and a first illumination device;

wherein in response to the plurality of fingers being in the closed position and surrounding an animal waste, a layer surrounding the animal waste and separating the animal waste and the plurality of fingers, the finger retainers being heatable to the first temperature sufficient to at least partially melt the layer proximate the finger retainers, the layer forming an enclosure surrounding the animal waste;

wherein the sound-emanating device includes a protective screen.

7. An animal waste extraction device comprising:

a hollow elongated member having a first end and a second end;

a gripper having a plurality of fingers, each finger having a retainer adapted to be selectively heated to a first temperature;

an actuator connected to the hollow elongated member and to the gripper, the actuator movable between a first position and a second position;

wherein in response to the actuator being in the first position, the plurality of fingers is in a closed retracted and located entirely inside the elongated member;

wherein in response to the actuator being in the second position, the plurality of fingers is in an open position and located entirely outside of the second end of the elongated member, the finger retainers insertable inside of a cover having an open end and a closed end, the finger retainers engaging the open end;

wherein in response to the actuator being in a third position between the first position and the second position, the plurality of fingers is in the closed position and extending at least partially outside the second end and surrounding the animal waste, the cover separating the animal waste and the plurality of fingers, the retainers being heatable to the first temperature sufficient to at least partially close the open end of the cover.

8. The device of claim 7, wherein the first end of the hollow elongated member includes a combination sound-emanating device and a first illumination device.

9. The device of claim 8, wherein the sound-emanating device includes a protective screen.

10. The device of claim 7, wherein the first end of the hollow elongated member includes a sound-emanating device and at least one illumination device.

11. The device of claim 7, wherein the first end of the hollow elongated member includes a heat source for selectively heating the finger retainers.

* * * * *